US005254232A

United States Patent [19]

Sadoway

[11] Patent Number: 5,254,232

[45] Date of Patent: * Oct. 19, 1993

[54] APPARATUS FOR THE ELECTROLYTIC PRODUCTION OF METALS

[75] Inventor: Donald R. Sadoway, Belmont, Mass.

[73] Assignee: Massachusetts Institute of Technology, Cambridge, Mass.

[ * ] Notice: The portion of the term of this patent subsequent to Mar. 12, 2008 has been disclaimed.

[21] Appl. No.: 832,748

[22] Filed: Feb. 7, 1992

[51] Int. Cl.[5] ..... C25C 3/06; C25C 3/08; C25C 3/12; C25C 7/00

[52] U.S. Cl. ..... 204/243 R; 204/244; 204/245; 204/290 R; 204/293

[58] Field of Search ..... 204/67, 243 R, 244-247, 204/292-293, 290 R, 64 R, 65, 266, 71

[56] References Cited

U.S. PATENT DOCUMENTS

| | | | |
|---|---|---|---|
| 3,502,553 | 3/1970 | Gruber | 204/293 X |
| 4,582,585 | 4/1986 | Ray | 204/293 X |
| 4,614,569 | 9/1986 | Duruz et al. | 204/290 R X |
| 4,620,905 | 11/1986 | Tarcy et al. | 204/293 X |
| 4,956,068 | 9/1990 | Nguyen et al. | 204/293 X |
| 4,960,494 | 10/1990 | Nguyen et al. | 204/290 R X |
| 4,999,097 | 3/1991 | Sadoway | 204/243 R |
| 5,019,224 | 5/1991 | Denton et al. | 204/290 F X |

*Primary Examiner*—Donald R. Valentine
*Attorney, Agent, or Firm*—Greenfield & Sacks

[57] ABSTRACT

Improved electrolytic cells for producing metals by the electrolytic reduction of a compound dissolved in a molten electrolyte are disclosed. In the improved cells, at least one electrode includes a protective layer comprising an oxide of the cell product metal formed upon an alloy of the cell product metal and a more noble metal.

In the case of an aluminum reduction cell, the electrode can comprise an alloy of aluminum with copper, nickel, iron, or combinations thereof, upon which is formed an aluminum oxide protective layer.

18 Claims, 3 Drawing Sheets

APPARATUS FOR THE ELECTROLYTIC PRODUCTION OF METALS

GOVERNMENT SUPPORT

Work described herein was supported in part by a grant from the United States Department of Energy.

BACKGROUND OF THE INVENTION

A variety of metals having significant industrial uses are not found naturally in their elemental forms. Rather, these metals are mined as a variety of compounds from which the desirable metal product must be extracted. One such metal is aluminum. Commercially, aluminum is produced from naturally occurring aluminum compounds by the electrolytic reduction of alumina $Al_2O_3$. Alumina is obtained from bauxite ore by the Bayer process which involves digesting crushed bauxite ore in strong caustic soda solution.

In 1886, Charles Hall in the United States and Paul Heroult in France independently developed the currently employed electrolytic process for extracting aluminum from alumina. This process, known today as the Hall-Heroult process, transformed aluminum from a precious metal into a common structural material. The process is still the most widely used commercial process for obtaining aluminum metal and is fundamentally the same as it was originally disclosed by Hall and Heroult in 1886.

In the Hall-Heroult process, electric current is passed through molten electrolyte containing alumina. An important feature of the Hall-Heroult discovery was that molten cryolite, a double salt of aluminum and sodium, represented by the chemical formula, $Na_3AlF_6$, would dissolve alumina and that the dissolved alumina could be electrolytically reduced to form molten aluminum metal.

The electrolytic reduction of metals is often performed in large cells or pots. These cells typically have massive carbon cathodes at the base and carbon anodes, normally formed in the shape of large blocks, suspended above the cell and capable of being lowered into the electrolyte. Direct electric current is passed from the anodes through the electrolyte to the carbon cathodes. During the reduction of alumina, for example, the carbon anodes are consumed in the chemical reaction occurring in the cell. This reaction can be represented, as follows:

$$2Al_2O_3 + 3C \rightarrow 4Al + 3CO_2.$$

This process yields an aluminum product that is very pure, e.g., 99.0% to 99.8%. The main impurities are traces of iron and silicon.

Despite its capability to produce high purity aluminum, the Hall-Heroult process has always suffered a number of significant problems. The most important of these arises from the use of consumable carbon anodes. These anodes are expensive to produce, and this cost adds significantly to the overall cost of aluminum produced by the Hall-Heroult process. Furthermore, it is difficult to maintain uniform anode current loading during use since the anodes are consumed, resulting in a continuous change in their shape.

Because of the problems associated with carbon anodes, substantial research has been conducted in an effort to find another anode material, in particular a material that would result in a non-consumable or inert anode. Unlike the carbon anode which is systematically consumed by a chemical reaction with the product of the faradaic process occurring at the anode, a non-consumable anode would act as a simple electron sink sustaining the evolution of pure oxygen. Such an anode is chemically inert with respect to the gas product generated by the electrochemical reaction. Under such conditions, it is expected that there would be no net consumption of the anode, and hence the anode would be non-consumable.

Another set of problems associated with electrolytic reduction cells arises from the lack of a suitable cathode material. Presently, carbon is used as the cathode material in these cells. Unfortunately, a product such as molten aluminum does not wet carbon. Therefore, in the case of aluminum production, it is necessary to maintain a deep pool of molten aluminum on the bottom of the cell. This is required because the carbon cathode surface must be fully covered in order to prevent contact between the molten salt electrolyte and the cathode itself in the presence of molten aluminum. Otherwise, the formation of aluminum carbide occurs, and this both reduces the productivity of the cell and consumes the carbon cathode.

The presence of the deep pool, however, creates a new problem. The cell currents are generally extremely high, typically on the order of about 100 kA to about 300 kA. At such currents, electromagnetic forces can cause the molten aluminum to develop waves of substantial physical dimension. To prevent electrical shorting of the molten aluminum to the anode, allowance must be made in the separation of the anode and cathode. This results in an excessive voltage drop across the electrolyte and contributes to poor energy utilization within the cells.

Problems such as those discussed above for Hall-Heroult cells also exist with other electrolytic cells and processes for the electrolytic production of metals from oxide based feed materials. This has in many instances, resulted in the metals being produced from more expensive feed materials or by use of more complicated and expensive processes than would be required if oxide based feed materials could be used.

As such, a need exists for electrodes for use in electrolytic cells for the reduction of oxide-based feed materials that are not consumed under the operating conditions of the cell, allow closer anode/cathode spacing, and can be shaped to configurations that are thermally and mechanically stable.

SUMMARY OF THE INVENTION

This invention relates to the discovery that material structures heretofore not considered useful in electrodes of cells for the electrolytic production of metals from oxide-based feed materials can be employed to provide improved electrolytic cells and processes for the electrolytic production of metals. In one embodiment, the invention pertains to electrode structures useful in Hall-Heroult cells for the electrolytic production of aluminum from aluminum oxide.

The improved electrodes, and particularly anodes of this invention, comprise at least an alloy of the product metal and a more noble metal upon which is formed an oxide of the product metal as a protective layer. Typically, the protective layer will comprise a metal oxide that is the same as that used to feed the cell. All surfaces in contact with the electrolyte in the cell are formed of the protective material.

Under the operating conditions of the cell, the protective material is rendered insoluble by the saturation conditions at the interface between the anode and the electrolyte. The saturation condition can be established in a number of ways such as by simple saturation of the bulk electrolyte with the material comprising the surface layer of the anode, or by generation of gas at the anode to establish saturation conditions in terms of the chemical potential of one of the constituents of the material comprising the surface layer. Beyond these chemical considerations, the materials forming the surface layer upon the electrode must be thermally and mechanically stable under the operating conditions of the cell.

For one embodiment of the invention, electrolyte contained within the cell is saturated with the feed material. Since the protective surface layer may also be formed of the feed material, this saturation acts to provide an additional measure of prevention against consumption of the electrode during cell operation. The saturation can be accomplished by running the cell for a sufficient period to saturate the electrolyte with materials released or discharged from the layer into the electrolyte or, preferably, by constituting the electrolyte so as to include a sufficient amount of the feed material to saturate the electrolyte prior to cell operation.

The use of oxides of the product metal (and especially cell feed materials) as a protective layer for the electrodes of an electrolytic cell results in significant advantages over the use of pre-baked carbon electrodes currently employed. For example, once the electrolyte is provided with the feed material at saturation levels, the anode becomes effectively non-consumable since the materials form a protective surface layer that effectively neither co-deposits with, nor is chemically displaced by, the metal product to any significant extent. It is noted that, although the protective layer may co-deposit, the co-deposited material comprises the product metal. Thus, effectively, there is no net co-deposition, as would be the case if the co-deposited material differed from that of the desired cell product. In the case of an aluminum reduction cell, the use of an anode made in accordance with the invention may result in small amounts of aluminum being co-deposited into aluminum product. However, this does not present a problem, since co-deposited aluminum is not a contaminant with respect to the aluminum product.

Anodes made according to the invention retain their shape thereby facilitating the maintenance of uniform current density in the electrolytic cell. The result is that problems encountered in maintaining proper anode/cathode spacing with consumable carbon electrodes are reduced. Thus, the inventive, inert electrodes obviate one of the major reasons necessitating the use of anode/cathode spacings greater than required which results in inordinate consumption of electrical energy. In addition based on the above, the inventive electrodes allow greater flexibility in the choice of operating conditions for the electrolytic cells.

The electrodes as described herein will also allow significant reductions in capital investment for the production of metals because they eliminate the need for expensive pre-baked carbon electrodes as well as the expensive baking facilities required to produce these carbon electrodes. Instead, the alloys and protective materials described above are readily obtainable in monolithic form or can be readily formed upon the surface of electrode foundations formed of less expensive, commodity materials. In addition, the anodes do not have to be replaced as frequently since they are essentially non-consumable. This reduces operating costs, as anode changes are labor intensive and result in significant cell down time.

DETAILED DESCRIPTION OF THE INVENTION

Although the present invention is intended to apply to all cells useful for the electrolytic reduction of metals from oxide-based feed materials, cells and processes for the production of aluminum are described in detail herein for the purpose of illustration. The invention, however, is not intended to be limited solely to aluminum production cells and processes.

Figure 1:
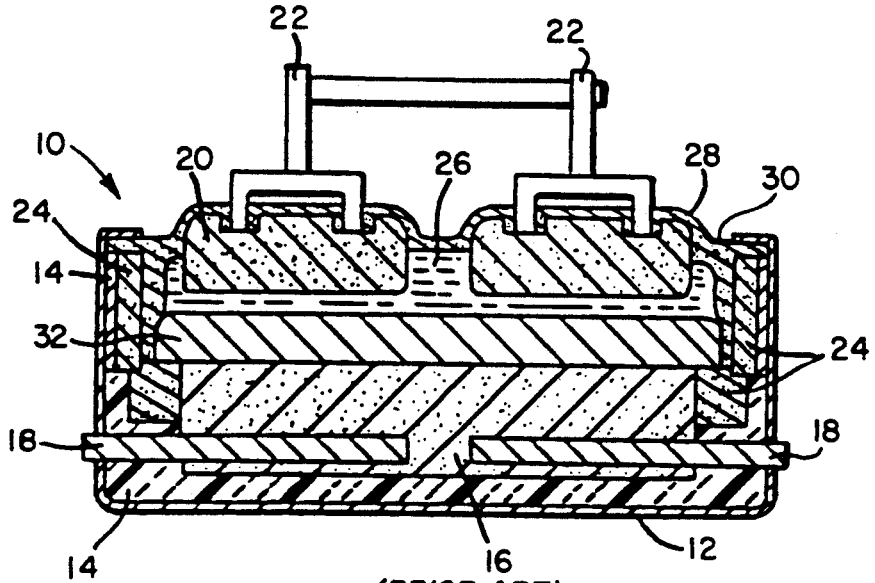
(PRIOR ART) Fig. 1
FIG. 1 is a schematic illustration of a Hall-Heroult cell of the type commonly employed in the commercial production of aluminum.

A conventional Hall-Heroult cell 10 employing pre-baked carbon anodes is illustrated schematically in FIG. 1. This cell has a steel outer shell 12 with thermal insulation 14 on the inside of shell 12. A carbon cathode 16 is positioned at the bottom of cell 10 and contains metallic current collector bars 18. Carbon anodes 20 are formed from pre-baked carbon blocks suspended from steel anode rods 22 which serve to supply electrical current to anodes 20. Cell lining 24 is also formed from carbon blocks.

Molten electrolyte 26 contains dissolved alumina supplied by breaking alumina crust 28 and adding fresh alumina. Crust 28 forms on frozen electrolyte and helps to minimize heat loss from the top of cell 10. Cryolite, $Na_3AlF_6$, is commonly employed as the principal constituent of the electrolyte since molten cryolite has the capacity to dissolve alumina. In addition, certain fluoride salts, such as aluminum fluoride, $AlF_3$, and calcium fluoride, $CaF_2$, are also present in the electrolyte. $AlF_3$ and $CaF_2$ decrease the freezing point of electrolyte and $AlF_3$ also improves current efficiency in the cell.

As electric current is passed from carbon anode 20 through molten electrolyte 26 to cathode 16, dissolved alumina is reduced to form molten aluminum layer 32 at the bottom of the Hall-Heroult cell and gas consisting of carbon dioxide and carbon monoxide is generated at the anode. Carbon anode 20 is consumed during this reaction in the approximate amount about ½ lb. of anode per lb. of aluminum product.

It is important to prevent molten electrolyte 26 from contacting carbon cell lining 24 to prevent cell lining failure caused by the formation of intercalation compounds and the formation and dissolution of $Al_4C_3$. To prevent such contact, cell 10 is operated under conditions that cause a layer of frozen electrolyte 30 to form between carbon cell lining 24 and molten electrolyte 26. Thus, molten electrolyte 26 is contained in a shell of frozen electrolyte and supported by a pad of molten aluminum 30. Unfortunately, during operation of the Hall-Heroult cell, the location of interface between molten and frozen electrolyte varies depending upon operating conditions. This adds to the difficulty in operating the cell under uniform conditions. As an alternative, cell linings having protective layers may be used within the cell. Such linings are described in detail in U.S. Pat. No. 4,999,097, the teachings of which are incorporated herein by reference.

Molten aluminum 30 does not wet the carbon cathode 16. Unfortunately, electro-deposition of aluminum directly on carbon permits the formation of aluminum carbide, $Al_4C_3$, which is soluble in the electrolyte. Such formation of aluminum carbide and its subsequent dissolution in the electrolyte consumes the carbon cathode, and hence, must be prevented. In practice, this is accomplished by covering the carbon cathode with a deep pool of molten aluminum. In this way, aluminum deposits onto molten aluminum rather than onto carbon. Furthermore, any aluminum carbide that forms at the interface between the aluminum pool and the carbon cathode must diffuse across the deep aluminum pool in order to dissolve in the electrolyte. However, there are disadvantages with this arrangement. The dimensional instabilities inherent in such a deep cathode pool of aluminum through which large electrical currents are passed require excessive spacing between the anode and cathode with all attendant disadvantages in order to prevent the dimensionally unstable aluminum pool from contacting the anode and electrically shorting the cell.

The present invention results from the discovery that certain alloys, capable of being provided with or forming a protective layer comprising an oxide of the cell product, can act as inert, non-consumable electrodes in electrolytic reduction cells. The protective surface layer materials of this invention have properties such that, despite their solubility in the electrolyte, there is no net consumption of the protective layer, and their presence in the electrolyte does not result in contamination of the metal product of the cell. In particular, the protective surface layer can preferably comprise an oxide of the ultimate cell product. Thus, for an aluminum cell, an $Al_2O_3$ productive layer is employed upon an alloy of aluminum and a metal more noble than aluminum.

The electrodes of the present invention comprise a variety of metal alloys on which protective films can be formed in situ during operation of the electrolytic cells or ex situ prior to cell operation. For example, in the latter instance, an oxide film can be produced on an anode by electrolytic anodization at room temperature in a citric acid solution. This is not intended to be limiting, however, as the art is rich with methods for forming oxides on metals.

The electrodes of the present invention comprise an alloy of the product metal with a more noble metal upon which is formed a protective layer comprising an oxide of the cell's product metal. In the case of an aluminum reduction cell, the electrode comprises an alloy of aluminum with a more noble metal (for example, copper, nickel, iron or combinations thereof) upon which is formed a thin aluminum oxide protective layer.

The oxide materials disclosed herein as electrode and cell protective layers are typically electrical insulators, i.e., high bandgap materials. Thus, they must be present as a relatively thin layer if they are to be used upon the electrodes of molten salt electrolysis cells. Otherwise, they will impart too great an electrical resistance on the electrodes, greatly increasing the amount of electricity needed to operate the cell.

An effective electrode can be achieved by making an electronically conductive portion, i.e., one with a low bandgap, upon which is formed or deposited an alloy and an electrode coating material of the type disclosed herein. The electronically conductive portion can be a metal, metal alloy, electronically conductive inorganic compound or solid solution. In one preferred embodiment, an electrode made in accordance with this invention can have a multi-layer structure comprising: 1) a foundation of commodity material formed into the bulk anode shape, 2) a first layer containing a metal alloy of the product metal and a more noble metal and 3) a protective layer covering the first layer and comprising an oxide of the product metal.

The foundation of the electrode is chosen from any of a variety of materials that are electrically conductive, inexpensive, and easily shaped to a desired anode configuration. Preferred foundation materials are copper, nickel, iron, or combinations thereof. An anode of this embodiment can comprise a copper or nickel foundation upon which a layer of aluminum/copper alloy is deposited. An $Al_2O_3$ protective layer is then formed upon the alloy layer. The protective layer must be kept as thin as possible to offer protection from chemical reaction of the anode with the electrolyte, while at the same time providing a minimum of increase in electrical resistance.

Alternatively, the base of the electrode material can be formed entirely of an alloy of the product metal with a more noble metal. If the concentration of aluminum exceeds a critical value, (approximately 4% by weight in copper for example), when oxidized, such a structure will form a protective layer comprising an oxide of the product metal upon a zone of metal. Constructions formed only of the specified alloys and lacking a foundation material are particularly desirable for an anode configuration that comprises a series of thin plates suspended vertically in the electrolyte. Alternatively, designs comprising a monolithic block with vertical chimneys to allow central venting of product oxygen gas evolving on external surfaces in contact with the electrolyte may be used.

Sharp compositional differences in electrode materials can result in thermal mismatches leading to potential delamination. To prevent such delamination, the alloy may be compositionally graded in a manner in which the mismatch in lattice parameters between the protective oxide surface layer and the underlying metal alloy is minimized.

The cathode can be constructed similarly; however, it need not be of the same specific construction as the anode. Rather, as long as the cathode is fabricated to have a construction satisfying the criteria above, it will be operable in the cell.

It should be apparent that the above are merely examples of the wide variety of electrode configurations that can be constructed in accordance with the invention. Thus, rather than being limiting, the examples are intended to be representative of electrodes having a specific class of protective surface layers formed upon a specific class of metallic alloys to yield a non-consumable electrode.

The protective surface layer material employed for the anode must also be resistant to additional oxidation since oxygen is generated at the anode. Thus, the protective surface layer material employed on the anode is preferably an oxy-compound with the particularly preferred materials being oxides or oxidation products. As used herein, the term oxidation is intended to refer to reactions in which the metal forming the protective layer undergoes an increase in valence as a result of the chemical reaction forming the protective layer. As an example, the reaction to form a protective layer of aluminum oxy-fluoride from aluminum metal is an oxidation reaction.

In the case of anodes and cathodes being made according to the present invention, it is not necessary that the same material construction be employed for both electrodes as long as all materials meet the criteria described herein. If the electrode materials are not the same, it is desirable to saturate the electrolyte with all materials so that none is consumed during operation of the cell.

Figure 2:
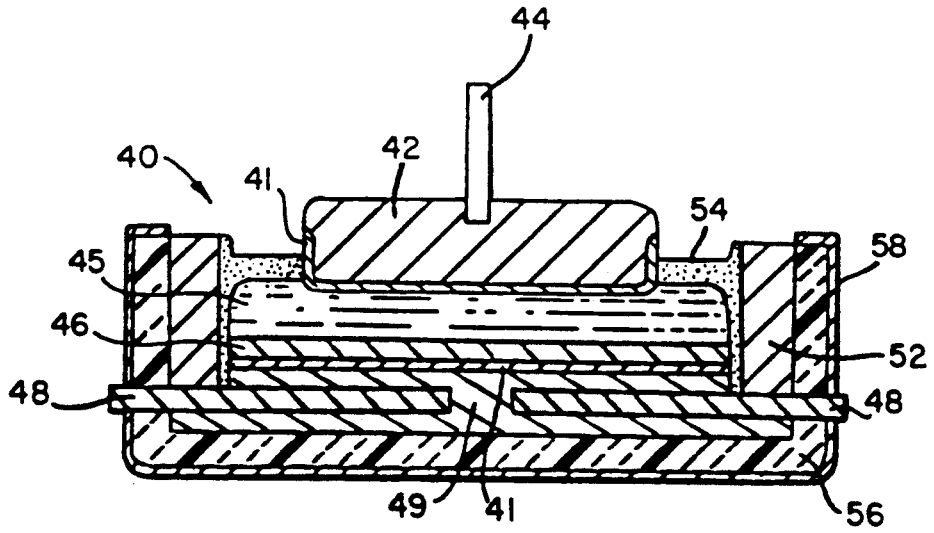
FIG. 2 is a schematic illustration of one embodiment of a Hall-Heroult cell modified according to this invention.

The use of electrode constructions satisfying the criteria described herein opens up new possibilities for the design of molten salt electrolytic cells. One such design, employing a horizontal monopolar anode, is schematically illustrated in FIG. 2. Electrolytic cell 40 has a steel outer shell 58 with thermal insulation 56 on the inside of the shell 58 and contains a single anode 42 at the top of cell 40. A protective surface layer 41 is present on the surface of the anode 42 at all surfaces of the anode which contact the molten electrolyte 45. Anode 42 is connected to a supply of electric current by anode rod 44. Molten aluminum 46 is produced on the top surface of the cathode located at the bottom of the cell. The cathode can be formed from a collector bar 48 embedded in a cathode block 49 which can be formed to have the same protective material layer 41 as the anode. Cell 40 includes a cell lining 52 covered with frozen electrolyte 54.

Figure 3:
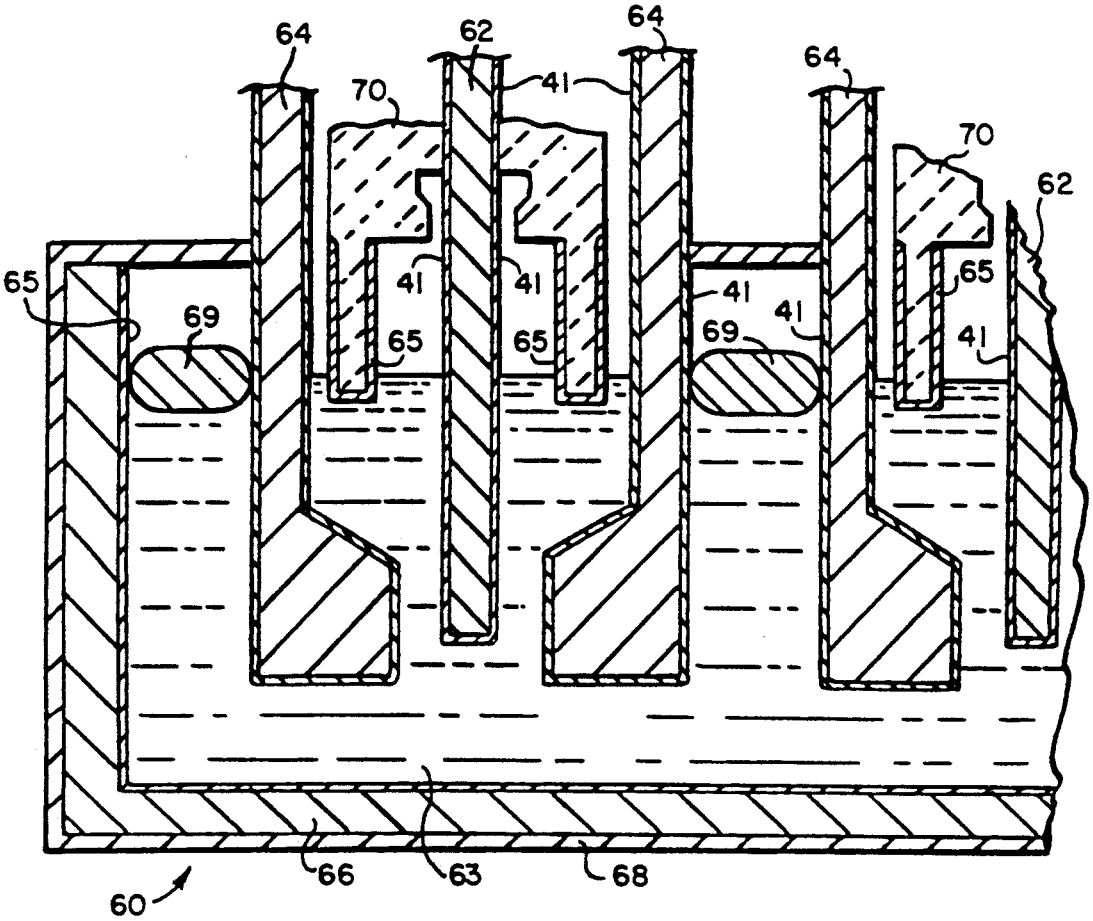
FIG. 3 is a schematic illustration of one embodiment of a vertical electrolytic reduction cell suitable for production of metals according to this invention.

Another design for a molten salt electrolytic cell employing materials meeting the criteria as described herein for the electrodes and cell lining is schematically illustrated in FIG. 3. Cell 60 has a series of vertically oriented anodes 62 formed having a protective surface from a material according to this invention. Cell 60 also contains a plurality of vertically oriented cathodes 64 which are preferably also formed in accordance with the teachings of this invention.

Cell lining 66, which is enclosed within a steel outer vessel 68, is also formed to have a protective surface layer 65, however, this layer is of a different material, and is of the type described in previously incorporated U.S. Pat. No. 4,999,097.

In the standard case where the relative density of liquid metal product is greater than that of the molten electrolyte, oxygen gas produced at anodes 62 rises to the melt surface and liquid metal product 69 falls to the bottom of cell 60. Alternatively, in a case where the relative density of liquid metal product and molten electrolyte is inverted from the value in a present cell, both the oxygen gas and liquid metal product rise to the melt surface. Under these conditions, it is desirable to interpose a retaining structure or semi-wall 70 between anodes 62 and cathodes 64 to prevent the buoyant liquid metal product from forming an electrical short between electrodes. The choice of material for semi-wall 70 is subject to the same considerations as the choice of material for lining 66. In order not to reduce the ability of the electrolyte to dissolve the oxide-based feed material, semi-wall 70 and lining 66 should preferably consist of the same material. The semi-wall 70 may also include a protective surface layer 65 of the type employed on the cell lining 66.

Figure 4:
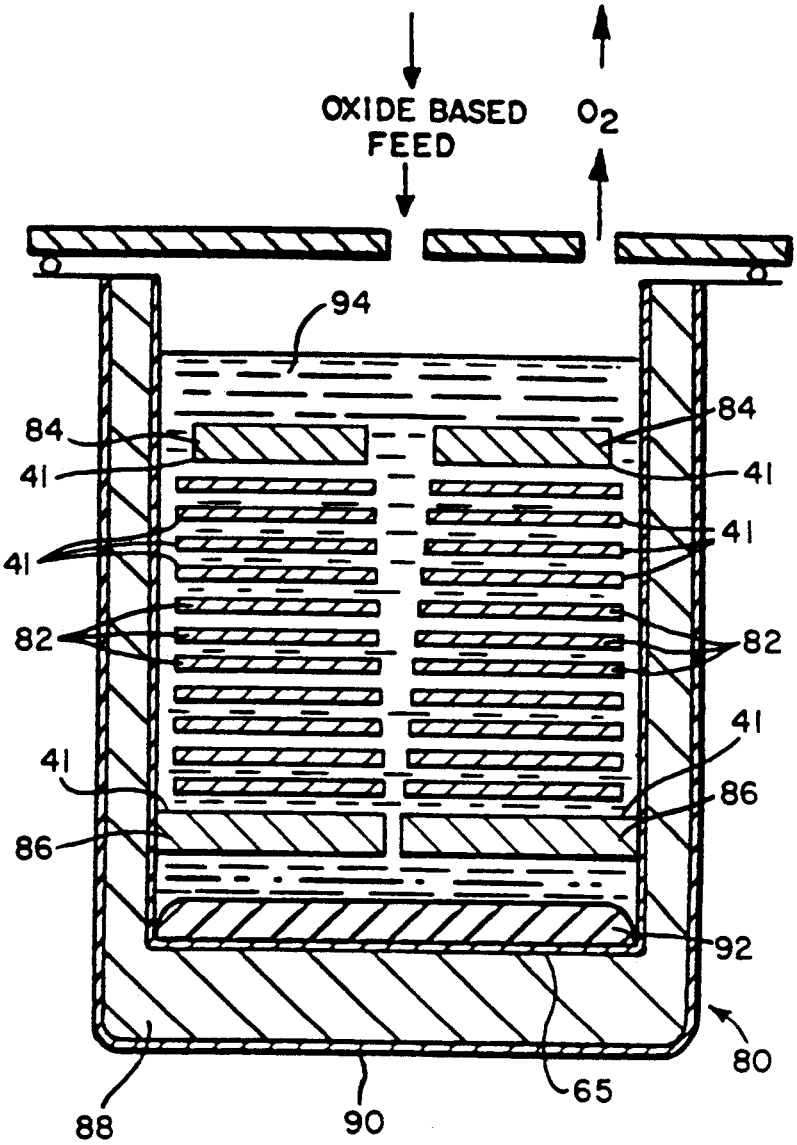
FIG. 4 is a schematic illustration of one embodiment of an electrolytic cell having bipolar electrodes suitable for the production of metals according to this invention.

Still another design for a molten bath electrolytic cell is schematically illustrated in FIG. 4. Cell 80 includes a horizontal bipolar electrode stack 82. In such a design, each electrode element consists of an anodic surface and a cathodic surface having a protective surface layer and separated from neighboring elements by electrically insulating spacers. A positive feeder electrode 84 and negative feeder electrode 86 are placed on the top and bottom of stack 82, respectively. Electrode elements have a foundation and a protective surface layer formed from the materials described previously. The cell lining 88, enclosed in steel jacket 90, can be selected to have the same protective material 65 as that of the cell in FIG. 3, or it can comprise a more conventional material. If liquid metal product 92 is denser than the molten electrolyte 94, the bipolar stack is charged to make the upper surface of each element cathodic and the lower surface anodic. By providing a central vent, enhanced circulation of the electrolyte can be achieved as a consequence of the gas lift. If the liquid metal product is less dense in the electrolyte, a vertical bipolar arrangement is preferred. In this case, both the liquid metal product and oxygen gas rise to the melt surface. In this case it is necessary to introduce a retaining structure or semi-wall to prevent the liquid metal product from shorting the cathode to the anode.

Figure 5:
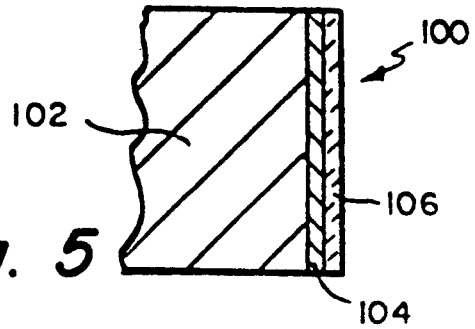
FIG. 5 is a schematic cross sectional illustration of one embodiment of a protective surface layer on an electrode according to this invention.

A cross sectional view of one embodiment of an electrode surface is represented schematically in FIG. 5. In this embodiment, the electrode 100, has a base 102, a metallic alloy layer 104 and an oxide layer 106. The base 102 is a material that is electrically conductive and readily formed into a desired electrode shape. The metallic alloy 104 comprises an alloy of the product metal and a more noble metal. In the case of an aluminum cell, the alloy 104 preferably comprises an alloy of aluminum with copper, nickel, iron or combinations thereof. The protective surface layer 106 comprises an oxide of the cell product metal. Thus, for aluminum cells, the protective surface layer comprises $Al_2O_3$.

Although the discussion above has largely been limited to electrolytic cells and methods for producing aluminum metal from molten salts, the materials described herein can also be employed in such cells and methods for producing other metals. For example, the criteria employed herein to select protective materials for the electrodes of aluminum cells can also be applied to select protective materials suitable for the production of magnesium, neodymium or other metals from oxide-based feed materials. In these cases, the material selected for the electrode must meet the same criteria adapted for the specific metal to be produced rather than for aluminum. Thus, the electrode will comprise at least an alloy of the product metal and a more noble metal upon which is formed an oxide by the product metal.

The invention will now be more particularly pointed out in the examples below.

EXAMPLES

Example 1

Aluminum Deposition Using an Aluminum Bronze Anode

Electrolytic production of aluminum was conducted in a laboratory-scale cell of the following design. The anode was a cylinder, 13/16 in. in diameter ×1 in. tall, made of an alloy having a composition of 11.8% by weight aluminum, with the balance being copper. An inconel rod, ⅛ in. in diameter, was welded to the top of the anode and served as the current lead. A sheath of hot-pressed boron nitride covered the vertical and upper surfaces of the anode. This was used both to restrict current flow to the bottom face of the anode and to protect the anode from exposure to the electrolyte at its free surface where it was suspected that conditions are highly corrosive. The cathode consisted of a shard of titanium diboride plate, ¼ in. thick, which was covered by a layer of aluminum metal. A tungsten rod, ⅛ in. in diameter, contacted the titanium diboride shard and served as the current collector. To prevent metal reduction on the tungsten rod it was isolated from the electolyte by means of a tube made of pyrolytic boron nitride.

The electrolyte was contained in an aluminum oxide crucible lined with a tube of the same material. This had the effect of giving the crucible a double wall so as to extend its service life. The electrolyte contained cryolite, $Na_3AlF_6$, and aluminum fluoride, $AlF_3$, in proportion to give a bath ratio of 1.15, calcium fluoride, $CaF_2$ in the amount of 5% by weight, and aluminum oxide in the amount exceeding its saturation value by 4% by weight.

Electrolysis was conducted for 47 hours. Cell temperature was 970° C. Cell current was 4 A. The cell was constantly flushed with a flow of argon gas. Oxygen was detected using an oxygen sensor in the argon stream exiting the cell. For 31 of the 47 hours, oxygen was detected in the exit gas, and during this time the cell voltage measured approximately 3.5 V. For the other 16 hours oxygen was not detected in the exit gas, and during this the cell voltage was 1.5 V.

The production of the aluminum was confirmed by weighing the metallic product at the bottom of the cell. The composition of this metal was confirmed by energy dispersive spectoscopy using a scanning electron microscope and found to be predominantly aluminum with a small amount of copper (on the order of about 1.7% by weight). The exact amount could not be determined as there was uncertainty in the weight of the initial charge of aluminum present in the cell at the beginning of the experiment and of the final aluminum content of the cell at the conclusion of the experiment. Even so, the presence of copper was attributed to the fact that for 16 of the 47 hours the cell was in operation, the cell voltage was below that expected for oxygen evolution. This oxygen evolution is a factor in establishing and maintaining the protective surface layer of aluminum oxide.

To the naked eye, the anode appeared intact and showed no evidence of dissolution. However, the anode had undergone a change in its shape and color. The anode appeared larger than its original dimension and its exterior was more copper colored. The anode was cut open, and the cross section showed an inner zone having the characteristic yellow bronze color. This was surrounded by an outer zone having a color more characteristic of copper metal. This is consistent with the observation that for some 16 hours no oxygen evolution could be confirmed. During this time it is expected that the anode reaction was the electrodissolution of aluminum. This example demonstrates that, provided the conditions in the cell maintain the oxide film on the surface, an anode having the composition used is capable of supporting the electrolytic production of aluminum with the generation of oxygen gas as the accompanying reaction.

Example 2

Aluminum Deposition Using an Aluminum Bronze Anode

Electrolytic production of aluminum was conducted in a laboratory-scale cell having a design similar to that of the previous example. However, in this example, the anode was made of an alloy consisting of aluminum in the amount of 15% by weight, with the balance being copper. No sheath protected the anode. The tungsten rod acting as the cathode current collector was sheathed with tubing made of aluminum oxide. The electrolyte composition was the same as that in Example 1.

Electrolysis was conducted for a period of 4 hours. Cell temperature was 970° C. Current was set at 10 A. Cell voltage was measured at between 5.0 and 5.6 V.

In confirmation of oxygen generation at the anode, oxygen was detected in the exit gas. The production of aluminum was confirmed by weighing the metallic product at the bottom of the cell. The composition of the metal product was confirmed by energy dispersive spectroscopy using a scanning electron microscope and found to contain 0.45% by weight copper, with the balance being aluminum and tungsten which had alloyed with the product metal in substantial amounts. The anode remained intact and showed no evidence of dissolution.

Example 3

Aluminum Deposition Using an Aluminum Bronze Anode - Electrolyte not saturated with aluminum oxide Electrolytic production of aluminum was conducted in a laboratory-scale cell having a design similar to that of the previous examples. The anode was made of an alloy consisting of aluminum in the amount of 15% by weight, with the balance being copper. No sheath protected the anode. The purpose of this test was to learn whether the anode could function in an electrolyte not saturated with aluminum oxide. Accordingly, no aluminum oxide was employed in the construction of the cell where it would be in direct contact with the electrolyte. The tungsten rod acting as cathode current collector was sheathed with tubing made of pyrolytic boron nitride. The electrolyte was contained in a crucible of pyrolytic boron nitride. The composition of the electrolyte was the same as that cited in the examples above with the exception of the concentration of aluminum oxide was present in the amount 7% by weight.

During the course of electrolysis the concentration of aluminum oxide decreased to a value of approximately 3% by weight. Electrolysis was conducted for a period of 2 hours. Cell temperature was 970° C. Current was set at 10 A. Cell voltage was measured at between 5.5 and 5.9 V.

In confirmation of oxygen generation at the anode, oxygen was detected in the exit gas. The production of aluminum was confirmed by weighing the metallic product at the bottom of the cell. The composition of this metal was confirmed by energy dispersive spectroscopy using a scanning electron microscope and found to be in excess of 99.3% by weight aluminum and 0.7% by weight copper. The anode remained intact and showed no evidence of dissolution.

Equivalents

Although the specific features of the invention are included in some embodiments and drawings and not in others, it should be noted that each feature may be combined with any or all of the other features in accordance with the invention.

Thus, the invention provides an inert, non-consumable electrode for use in electrolytic cells for the production of metals from oxide based feed materials.

It should be understood, however, that the foregoing description of the invention is intended merely to be illustrative thereof, that the illustrative embodiments are presented by way of example only, and that other modifications, embodiments, and equivalents may be apparent to those skilled in the art without departing from its spirit.

Having thus described the invention, what we desire to claim and secure by Letters Patent is:

1. An electrode for use in an electrolytic cell for the production of a metal product by the electrochemical reduction of an oxide based feed material dissolved in a molten electrolyte, wherein the electrode comprises a metallic alloy of the metal product and a metal more noble than the metal product and further wherein, under the operating conditions of the cell, all surfaces of the electrode that contact the electrolyte comprise a protective layer comprising an oxide of the metal product of the cell.

2. An electrode as in claim 1 wherein the electrolytic cell is an aluminum reduction cell.

3. An electrode as is claim 2 wherein the metallic alloy is an alloy of aluminum and a metal selected from the group consisting of copper, nickel, iron and combinations thereof.

4. An electrode as is claim 1 wherein the electrode is an anode.

5. An electrode as is claim 1 wherein the protective layer is formed upon the metallic alloy prior to introduction of the electrode into the electrolytic cell.

6. An electrode as is claim 1 wherein the oxide of the cell product comprises a material identical to that of the oxide based feed material.

7. An electrode as is claim 1 wherein the metallic alloy comprises a layer upon the surface of a commodity foundation material.

8. An electrode as is claim 7 wherein the commodity foundation material comprises a material selected from the group consisting of copper, nickel, iron and combinations thereof.

9. An anode for use in an electrolytic cell for the production of aluminum by the electrochemical reduction of aluminum oxide dissolved in an electrolyte, wherein the anode comprises an alloy of aluminum and a metal more noble than aluminum, upon which, under the operating conditions of the cell and on all surfaces of the electrode that contact the electrolyte, exists a protective layer comprising aluminum oxide.

10. An anode as is claim 9 wherein the metal more noble than aluminum comprises a material selected from the group consisting of copper, nickel, iron and combinations thereof.

11. An electrolytic cell for the production of a metal product by the electrolytic reduction of an oxide based feed material dissolved in a molten electrolyte, said cell comprising a vessel for containing the molten electrolyte, a vessel lining in contact with the electrolyte, an anode and a cathode, wherein at least one of said anode and cathode comprises a metallic alloy of the metal product and a metal more noble than the metal product, upon which, under the operating conditions of the cell and on all surfaces which contact the electrolyte, exists a protective layer comprising an oxide of the metal product.

12. An electrolytic cell as in claim 11 which comprises an aluminum reduction cell.

13. An electrolytic cell as in claim 12 wherein the metallic alloy comprises an alloy of aluminum and a material selected from the group consisting of copper, nickel, iron and combinations thereof.

14. An electrolytic cell as in claim 13 wherein the protective layer comprises aluminum oxide.

15. An electrolytic cell for the production of a metal product by the electrolytic reduction of an oxide based feed material dissolved in a molten electrolyte, said cell comprising a vessel for containing the molten electrolyte, a vessel lining in contact with the electrolyte, at least one vertically oriented anode paired with at least one vertically oriented cathode, wherein at least one of the anode or the cathode comprises of an alloy of the product metal and a metal more noble than the product metal upon which, under the operating conditions of the cell and on all surfaces which contact the electrolyte, exists a protective layer comprising an oxide of the product metal.

16. An electrolytic cell as in claim 15 which comprises an aluminum reduction cell.

17. An electrolytic cell for the production of a metal product by the electrolytic reduction of an oxide based feed material in a molten electrolyte, said cell comprising a vessel for containing the molten electrolyte, a vessel lining in contact with the electrolyte, and a horizontal bipolar electrode stack disposed between a positive feeder electrode and a negative feeder electrode, wherein at least one of said positive feeder electrode, negative feeder electrode, or the bipolar electrode stack, comprises an alloy of the product metal with a metal that is more noble than the product metal upon which, under the operating conditions of the cell and on all surfaces that contact the electrolyte, exists a protective layer comprising an oxide of the product metal.

18. An electrolytic cell as in claim 17 which comprises an aluminum reduction cell.

* * * * *

UNITED STATES PATENT AND TRADEMARK OFFICE

CERTIFICATE OF CORRECTION

PATENT NO. : 5,254,232

DATED : October 19, 1993

INVENTOR(S) : Donald R. Sadoway

It is certified that error appears in the above-indentified patent and that said Letters Patent is hereby corrected as shown below:

Column 1, under the heading GOVERNMENT SUPPORT, delete "Work described herein was supported in part by a grant from the United States Department of Energy." and insert therefor ---The U.S. Government has a paid-up license in this invention and the right in limited circumstances to require the patent owner to license others on reasonable terms as provided for by the terms of Contract No. DE-FG07-83ID12380 awarded by the Department of Energy.---

Signed and Sealed this

Twenty-sixth Day of July, 1994

*Attest:*

*Attesting Officer*

BRUCE LEHMAN

*Commissioner of Patents and Trademarks*